US005084072A

United States Patent [19]

Reynolds

[11] Patent Number: 5,084,072

[45] Date of Patent: Jan. 28, 1992

[54] WET WALL ELECTROSTATIC PRECIPITATOR WITH LIQUID RECYCLE

[75] Inventor: James T. Reynolds, Island Heights, N.J.

[73] Assignee: Croll-Reynolds Company, Inc., N.J.

[21] Appl. No.: 502,840

[22] Filed: Mar. 30, 1990

[51] Int. Cl.[5] ..... B03C 3/00

[52] U.S. Cl. ..... 55/8; 55/10; 55/122; 55/127; 55/146; 55/155; 55/119

[58] Field of Search ..... 55/8, 10, 13, 108, 117, 55/118, 119, 122, 127, 135, 146, 151, 154, 155, 156

[56] References Cited

U.S. PATENT DOCUMENTS

| | | | |
|---|---|---|---|
| 4,117,255 | 9/1978 | Kawaike et al. | 55/146 |
| 4,597,780 | 7/1986 | Reit | 55/119 |

FOREIGN PATENT DOCUMENTS

| | | | |
|---|---|---|---|
| 1137427 | 12/1982 | Canada | 55/127 |
| 1322565 | 2/1963 | France | 55/8 |
| 61946 | 10/1980 | Japan | 55/10 |
| 807124 | 1/1959 | United Kingdom | 55/119 |

*Primary Examiner*—Bernard Nozick
*Attorney, Agent, or Firm*—Bierman and Muserlian

[57] ABSTRACT

An improved wet wall electrostatic precipitation unit of the type wherein a constant liquid stream is maintained over the inside surface of a glass collector tube and a discharge electrode, to which a voltage is applied, extends substantially through the center of the tube between the upper and lower ends thereof, to repel smoke particles, forcing them into the liquid stream. The liquid from the liquid stream, discharged at the bottom of the glass tube is recycled to the top of the collector tube after adjustment of the pH to render the liquid caustic. The caustic nature of the recycle liquid prevents smoke from streaking the collector tube thereby improving efficiency.

21 Claims, 2 Drawing Sheets

WET WALL ELECTROSTATIC PRECIPITATOR WITH LIQUID RECYCLE

FIELD OF THE INVENTION

The present invention relates to a wet wall electrostatic precipitator and, more particularly, to an improved wet wall electrostatic precipitator wherein the wall wetting liquid is rendered caustic after discharge and recycled. The inventive precipitator is especially suitable for removing particles from meat smoke.

DESCRIPTION OF THE PRIOR ART

Electrostatic precipitators, in general, are well known in the art. Dry wall precipitators of this type as described in, for example, U.S. Pat. No. 4,588,423 to Gillingham et al, comprise a discharge wire axially mounted within a collector tube. A voltage is applied to the discharge wire establishing an electrostatic field at the center of the collector tube. A contaminated gas stream, or smoke, is drawn through the collector tube by suction or other means.

As the gas stream passes through the collector tube, the electrostatic field causes the particles to ionize and become attracted to the wall of the collector tube. In theory, the separated particles move down around the wall and can be removed through an outlet. Large particles can be better separated from the gas stream by tangentially introducing the stream into the collector tube, as shown in, for example, U.S. Pat. No. 3,970,437 to Van Diepenbrock et al. By so introducing the gas stream, a "cyclone effect" is achieved and large particles are centrifically driven to the collector tube wall.

While the above-described "dry wall" electrostatic precipitators work relatively well with gas streams containing dry particulate such as dust, difficulties arise when the gas stream has a high moisture content. Moisture causes the separated particles to adhere to the collector tube walls and the walls that must therefore be regularly cleaned in order to prevent build up and the resultant lower efficiency. Cleaning requires that the precipitator be shut down causing production delays as well as maintenance expenses. Similar problems are encountered when the gas stream contains soot or grease.

In order to reduce the above-described build up, wet wall electrostatic precipitating units as described in, for example, U.S. Pat. No. 4,529,418 or U.S. Pat. No. 4,597,789, both to Reif, a downwardly flowing continuous water film is established on the collector tube wall. Particles are entrained in the film and are constantly flushed away. Again, in an attempt to increase separation ability, it was suggested that, as is set forth in U.S. Pat. No. 4,308,038, the gas stream be introduced tangentially to impart a cyclone effect and centrifically drive larger particles into the water film.

While the introduction of the downwardly flowing water film greatly improved efficiency and reduced contaminant build up on the walls of the separator tube, residue build up remained a problem, particularly when the gas stream contained soot or grease. Methods suggested for reducing residue build up included "pulsing" the gas stream as described in U.S. Pat. No. 4,388,089 to Reif et al; however, none were found to be adequately effective, especially with problematic gas streams such as smoke from meat smokehouses. The inventive precipitator is particularly well suited to separating particle matters from smoke of this type.

SUMMARY OF THE PRESENT INVENTION

It is therefore an object of the present invention to provide a wet wall electrostatic precipitation unit which reliably and effectively extracts particulate from contaminated gas streams, particularly meat smokehouse smoke, while preventing particulate build up on inner walls of the collector tube. More particularly, the invention is directed to a wet wall electrostatic precipitator wherein the liquid used to maintain the film on the collector walls is recycled back to the top of the tube after discharge, recycle liquid being continuously treated with an agent which prevents particulate build up on the collector walls.

It is an additional object of the invention to provide a means to prevent particulate build up in the area in which the discharge wire attaches to the collector tube. This build up is commonly encountered and has been found to cause sparking between the wire and the collector tube walls. This phenomenon, in turn, requires a lower voltage to be applied and therefore decreases efficiency.

Briefly stated, the above primary object of the invention, the prevention of particulate build up on the collector walls, is accomplished by providing a caustic reservoir which maintains the recycle liquid at a caustic pH, more specifially, a pH of 11 to 12. The recycled liquid (which contains smoke contaminants) also acts as a surfactant which helps keep the walls wet. Constant maintenance of the pH is required as most house smoke is acidic in nature and lowers the pH of the liquid. A bleed and water make up prevents excessive conductivity build up which causes sparking. The secondary object of the invention can be achieved by enclosing the upper end portion of the discharge wire within a stepped, insular tube, and maintaining an air stream flowing thereover.

BRIEF DESCRIPTION OF THE DRAWINGS

The following description of the invention is made with reference to the accompanying drawings wherein.

DETAILED DESCRIPTION OF THE INVENTION

Figure 1:
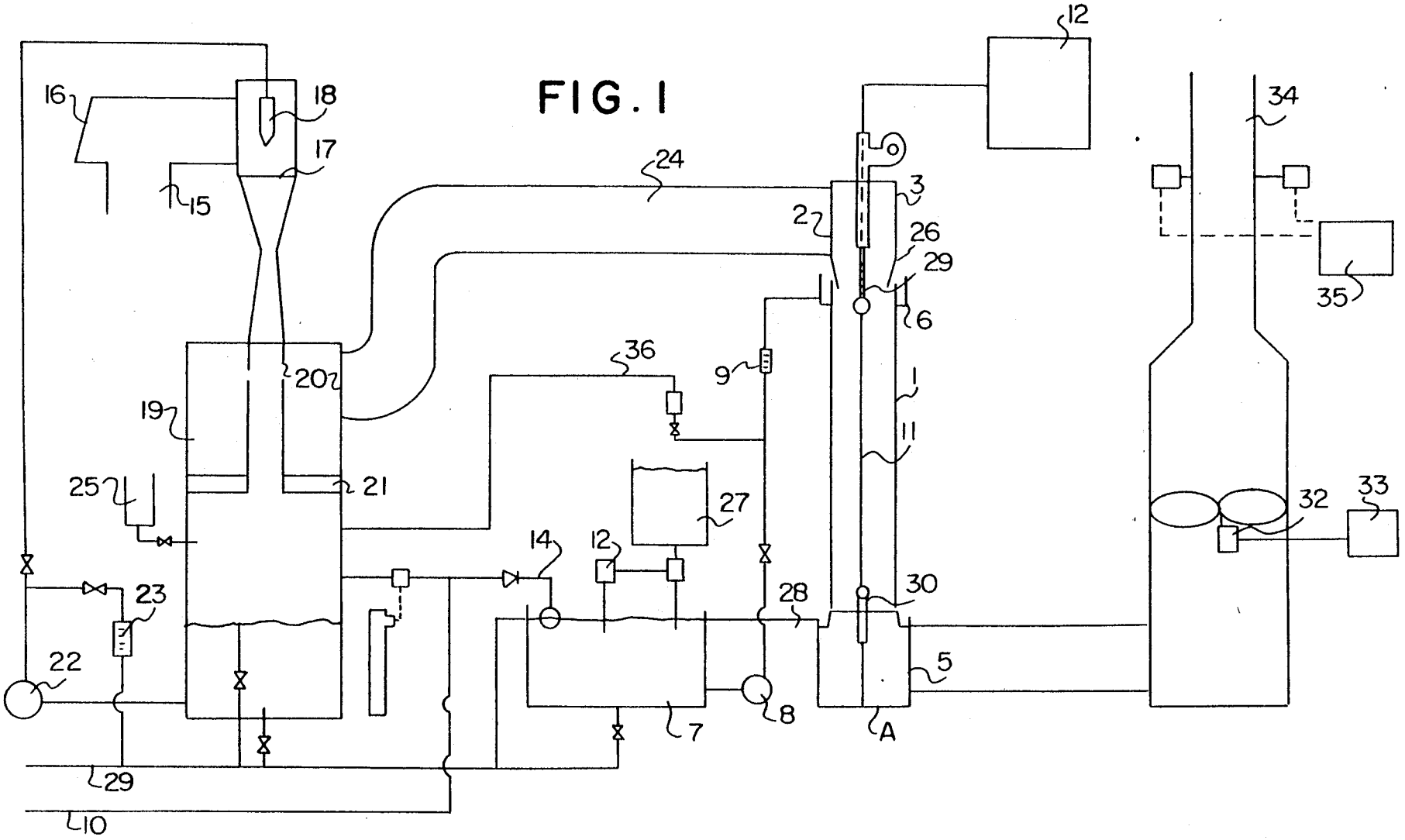
FIG. 1 schematically represents the preferred process and apparatus of the invention.

Referring now to FIG. 1 which illustrates a preferred embodiment of the inventive electrostatic precipitator, as shown, the precipitator includes a collector tube 1, preferably made of glass. An inlet section 2 is formed in an upper cover 3 which encloses the upper end of the collector tube 1. The lower end of the collector tube is enclosed by a lower cover 4 having an outlet section 5. Encircling the collector tube 1 is a solution distribution weir 6, shrouded by a weir shroud 26. After the system is initially charged with a supply line 10, liquid is pumped from a recycle tank 7 by a pump 8 to distribution weir 6. The pipe through which the liquid is supplied to the distribution weir 6 is equipped with a flow meter 9.

Axially mounted at a central position in the collector tube 1 is a high voltage discharge electrode assembly including a discharge wire 11 extending between the upper 3 and lower 4 cover. Insulated mounting pieces 29, 30 prevent the discharge wire 11 from grounding against the covers 3, 4. A voltage is applied to the discharge wire by a power source 12.

Dense smoke is introduced into the apparatus through a gas stream inlet 15 and mixed with an approximately equal amount of air drawn through an air bleed damper 16. The combined smoke stream is pretreated by a venturi scrubber 17. In the scrubber 17, the gas is saturated with a high pH solution supplied through a scrubber nozzle 18. Larger smoke particles are captured in the high pH solution which is then discharged, along with the smoke stream, to a separator tank 19.

In the separator tank 19, the smoke is discharged through a separator tank gas outlet 20, while the high pH solution flows to the bottom of the tank. Mist is prevented from becoming entrained in the smoke screen by a mist eliminator 21. The high pH solution is recycled to the venturi scrubber 17 by a pump 22. A solution bleed flow meter 23 controls the amount of solution bled from the system to the drain. Foam, in a separator tank 19, is reduced by adding an antifoaming agent controlled by an antifoam solution control 25.

The pretreated gas stream is led from the separator tank gas outlet 20 to the collector tube inlet section 2 by a duct 24 and introduced tangentially into the collector tube 1 to impart a spinning motion on the smoke stream. The interior walls of the collector tube 1 are flushed with a high pH solution supplied through a solution distribution weir 6 to form a continuous, downwardly flowing wetted wall film which flows to the bottom of the collector 1 where the wall film is separated from the cleansed smoke and discharged to the recycle tank 7 through a pipe 28. Larger smoke particles are driven to the wetted wall film by centrifical force. The electrostatic field established between the discharge wire 11 and the wet wall film impart a charge on the remaining particles which are further attracted to the wet wall film.

Turning now to the means for accomplishing the primary object of the invention, a pH control 12 constantly monitors the pH of the recycle solution contained in the recycle tank 7 and maintains the pH thereof between 11 and 12 by either adding a caustic from a caustic reservoir 27 or, additional water make up float control valve 14. Constant monitoring and adjusting of the pH is necessary as the smoke particles affect the pH of the wall wetting solution. If the pH of the wall wetting solution is increased above, or decreased below the 11 to 12 range, smoke streaks form on the collector tube glass. A constant bleed from the recycle tank 7 is directed to the separator tank 19 through a flow meter 36. Both the separator tank 19 and recycle tank 7 can be drained through a drain line 29.

To reduce sparking or arcing between the discharge wire 11 and the collector tube 1, it is essential that residue be prevented from building up around the discharge wire. This build up is especially problematic at the upper end of the discharge wire 11, which is attached to the upper tube cover 3 in close proximity to the inlet section 2. In order to prevent residue build up, the upper mounting piece 30 is formed as a stepped tube. A blower 31 is provided which blows through the larger diameter portion of the tube around the outside of the smaller diameter tube, maintaining a constant air stream flowing thereover.

In order to pull the smoke through the apparatus, suction is required and a vacuum is provided by a fan 32 powdered by a motor 33. The purified gas stream is exhausted through a chimney 34. Exhaust stream quality is continuously monitored by a smoke monitor 35.

Figure 2:
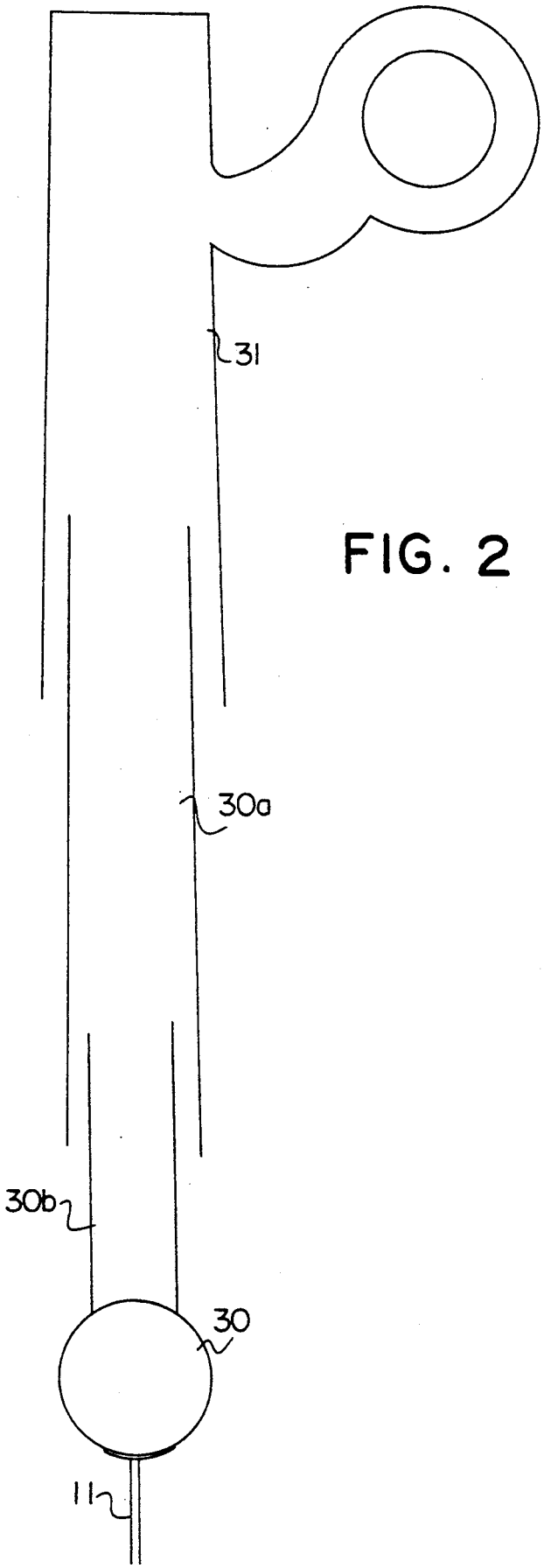
FIG. 2 illustrates the inventive discharge wire assembly, in front section view.

FIG. 2 illustrates the discharge wire assembly in more detail. As is shown, the discharge wire 11 is mounted axially within the collector tube (not shown) by an upper mounting piece 30. The mounting piece is formed as a stepped tube made of an insular material, Teflon being preferable. The blower 31 blows an air stream through the larger diameter portion of the tube 30*a* which directs the air stream around the outer surface of the smaller diameter tube portion 30*b*, forming a continuous air stream over the top portion of the discharge wire 11.

While preferred embodiments have been shown and described, various modifications and substitutions may be made thereto without departing from the spirit and scope of the invention. Accordingly, it will be understood that the present invention is not to be limited except by the character of the claims appended hereto.

We claim:

1. A method of extracting particles from a smoke stream with an electrostatic wet wall precipitator unit comprising a discharge electrode assembly axially mounted within a glass collector tube, said method comprising;

applying a voltage to said discharge electrode assembly to establish an electrostatic field and cause ions to be generated in a center area of said tube surrounding said wire;

introducing a liquid into said tube at the upper end thereof and forming a liquid film on an inner surface of said tube which flows downwardly and is discharged;

tangentially introducing said smoke stream into said tube at the top end thereof, drawing said stream through said tube and discharging said stream collecting a liquid discharge;

the improvement comprising adjusting the pH of the discharge liquid to caustic conditions of at least 11 and recycling the adjusted discharge liquid to the upper end of said tube, whereby the liquid film has a pH of at least 11.

2. The method of claim 1 wherein the pH of the liquid film is maintained between about 11 and 12.

3. The method of claim 1 wherein a portion of said electrode adjacent to an upper end of said tube is encased within an insular tube and a steady air stream is blown over the outside surface of said insular tube.

4. The method of claim 3 wherein the pretreated smoke from a venturi scrubber is fed to said unit after said caustic solution is separated from said smoke stream, this being prevented from becoming entrained in the pretreated smoke during the separation of the caustic solution from said smoke stream.

5. The method of claim 1 wherein the discharge liquid is discharged to a recycle tank, the pH of the discharge liquid is adjusted, and the pH adjusted discharge liquid is recycled to the upper end of said glass collector tube.

6. The method of claim 5 wherein the separated caustic solution is recycled to a venturi scrubber.

7. An improved wet wall electrostatic precipitation unit for extracting particles from a smoke stream, said unit comprising, a vertically mounted glass collector tube, an upper end of said tube being enclosed by a cover having an inlet section, a lower end of said tube being enclosed by a cover having an outlet section;

a discharge electrode assembly comprising a wire extending substantially through the center of said tube between the upper and lower tube ends, and having a voltage applied thereto to establish an electrostatic field and cause ions to be generated in a center area of said tube, surrounding said wires;

means for introducing a liquid into said tube at said upper end through a liquid inlet to form a liquid film on an inner surface of said glass tube which flows downwardly into, and is discharged through a liquid discharge portion of said outlet section;

means for tangentially introducing said smoke stream into said inlet section and;

suction means for drawing said stream through said tube and out through a gas discharge portion of said outlet section;

the improvement comprising means for recycling a portion of the liquid discharge to the top of the collector tube and means for adjustment of the pH to render the liquid caustic.

8. The unit of claim 1 further comprising a smoke monitor for monitoring the quality of the discharged smoke stream.

9. The unit of claim 1 wherein a portion of said electrode adjacent to said upper tube end is encased within an electrically insular tube.

10. The unit of claim 9 wherein said insular tube is made of Teflon.

11. The unit of claim 9 wherein said electrically insular tube has at least one step formed on the outside surface thereof.

12. The unit of claim 11 wherein said discharge electrode assembly further comprises a blower for maintaining an air stream over the outside surface of the lower portion of the stepped insular tube.

13. The unit of claim 1 wherein means for discharging the liquid from said outlet section to a recycle tank and means for supplying said liquid to said liquid inlet from said recycle tank.

14. The unit of claim 13 wherein said recycle tank includes means for supplying to a caustic reservoir for maintaining alkalinity of at least 11 in the recycle liquid supplied to said liquid inlet.

15. An improved wet wall electrostatic precipitation unit for extracting particles from a smoke gas stream, said unit comprising a venturi scrubber wherein said said smoke stream is pretreated by saturation with a caustic solution to remove large smoke particles therefrom, a vertically mounted glass collector tube, an upper end of said tube being enclosed by a cover having an inlet section, a lower end of said tube being enclosed by a cover having an outlet section;

a discharge electrode assembly comprising a wire extending substantially through the center of said tube between the upper and lower tube ends and having a voltage applied thereto to establish an electrostatic field and to cause ions to be generated in a center area of said tube surrounding said wire;

means for introducing a liquid into said tube at said upper end through a liquid inlet to form a liquid film on an inner surface of said gas tube which flows downwardly into, and is discharged through a liquid discharge portion of said outlet section means for tangentially introducing said smoke stream into said inlet section and;

suction means for drying said stream through said tube and out through a gas discharge portion of said outlet section;

the improvement comprising means for recycling a portion of the liquid discharged to the top of the collector tube after adjustment of the pH to render the liquid caustic.

16. The unit of claim 15 wherein said venturi scrubber includes a separator tank wherein the caustic solution is separated from said smoke stream.

17. The unit of claim 16 wherein said separator tank further comprises a mist eliminator which prevents caustic solution mist from becoming entrained in the pretreated smoke supplied to said unit.

18. The unit of claim 16 wherein means are provided for discharging the liquid from said outlet section to a recycle tank and means for supplying liquid to said liquid inlet from said recycle tank.

19. The unit of claim 18 wherein said recycle tank is supplied with a caustic for maintaining alkalinity of at least 11 in the recycled liquids supplied to said liquid inlet.

20. The unit of claim 18 including means for introducing overflow from said recycle tank into said separator tank.

21. The unit of claim 20 including means for recycling liquid from said separator tank to said venturi scrubber.

* * * * *